US005692879A

United States Patent [19]

Charbonnel

[11] Patent Number: 5,692,879

[45] Date of Patent: Dec. 2, 1997

[54] CONTROL DEVICE FOR A STAGE OF BLADES WITH VARIABLE PITCH

[75] Inventor: Jean-Louis Charbonnel, Boissise Le Roi, France

[73] Assignee: Societe Nationale d'Etude et de Construction De Moteurs d'Aviation SNECMA, Paris, France

[21] Appl. No.: 717,193

[22] Filed: Sep. 20, 1996

[30] Foreign Application Priority Data

Sep. 27, 1995 [FR] France ..... 9511301

[51] Int. Cl.[6] ..... F04D 29/44

[52] U.S. Cl. ..... 415/159; 415/160; 415/162

[58] Field of Search ..... 415/150, 155, 415/158, 159, 160, 162, 163

[56] References Cited

U.S. PATENT DOCUMENTS

| | | | |
|---|---|---|---|
| 2,999,630 | 9/1961 | Warren et al. . | |
| 4,295,784 | 10/1981 | Manning . | |
| 4,400,135 | 8/1983 | Thebert . | |
| 5,035,572 | 7/1991 | Popp | 415/150 |
| 5,044,879 | 9/1991 | Farrar | 415/150 |
| 5,224,820 | 7/1993 | Brichet et al. . | |
| 5,466,122 | 11/1995 | Charbonnel et al. | 415/160 |

FOREIGN PATENT DOCUMENTS

| | | |
|---|---|---|
| 0 094 296 | 11/1983 | European Pat. Off. . |
| 1 601 625 | 8/1970 | Germany . |
| 2 187 237 | 9/1987 | United Kingdom . |

*Primary Examiner*—John T. Kwon

*Attorney, Agent, or Firm*—Oblon, Spivak, McClelland, Maier & Neustadt, P.C.

[57] ABSTRACT

Device for controlling pivoting blades or variable pitch blades (3) in a gas turbine in which the control ring (10) rotates under the effect of an angled cam (15) controlled by a system with a connecting rod (22) and crank (21). This system imposes a non-linear rotation law between the blades (3) and the crank (21).

3 Claims, 4 Drawing Sheets

3
8
3
10
9
β
β0
11
13
12
15
14
16
18
23
21
26
22
24
19
17
ℓ
ℓa
15a
16a
17a
ℓb
15b
16b
ℓc
15c
16c
20

CONTROL DEVICE FOR A STAGE OF BLADES WITH VARIABLE PITCH

DESCRIPTION

The invention relates to a device for controlling a stage with pivoting blades or variable pitch blades.

These types of blades are used on stators in some aircraft engines: depending on the machine speed, it becomes necessary to more or less straighten the gas stream passing through these blade stages, which are therefore pivoted about their axes under the action of a control mechanism located on the other side of the stator.

Blade pivots that pass through the stator are joined together to control levers that are all connected to a control ring that surrounds the stator, and that is rotated by a control mechanism.

There are many different types of control mechanism, which require the use of an activating device such as a cylinder and a transmission mechanism composed of levers, connecting rods etc. The characteristics of these transmissions are quite varied and some enable non-linear controls of blades, i.e. the rotation of the blades is not proportional to the actuator displacement. The invention belongs to this family of control devices, and its main advantage is that the transmission is particularly simple.

In its most general form, the invention relates to a control device for a stage of variable pitch blades fitted with levers connected to a control ring, the control ring being hinged to a cam that pivots about a first fixed axis, characterized in that the cam is connected to a control crank that rotates about a second fixed axis parallel to the first axis, by a connecting rod hinged to the cam and to the rotating crank at several points on the fixed axes.

The control device may also relate to several stages of blades and several control rings at the same time. In order to apply the invention, other hinged cams can then be installed pivoting about other first fixed axes to other control rings on other stages of blades with variable pitch, the cams being connected together by a synchronization bar hinged to the cams at exactly the same positions with respect to the first fixed axes. Or, in a different design, there are other hinged cams pivoting about other first fixed axes to other control rings in other stages of blades with variable pitch, the other cams being connected together and to the rotating crank by a synchronization bar hinged to other cams and to the crank at exactly the same positions with respect to the other first fixed axes and the second fixed axis.

The invention will now be described in more detail with reference to the following figures which are included in the appendix and are provided for illustration, without being restrictive:

Figure 1:
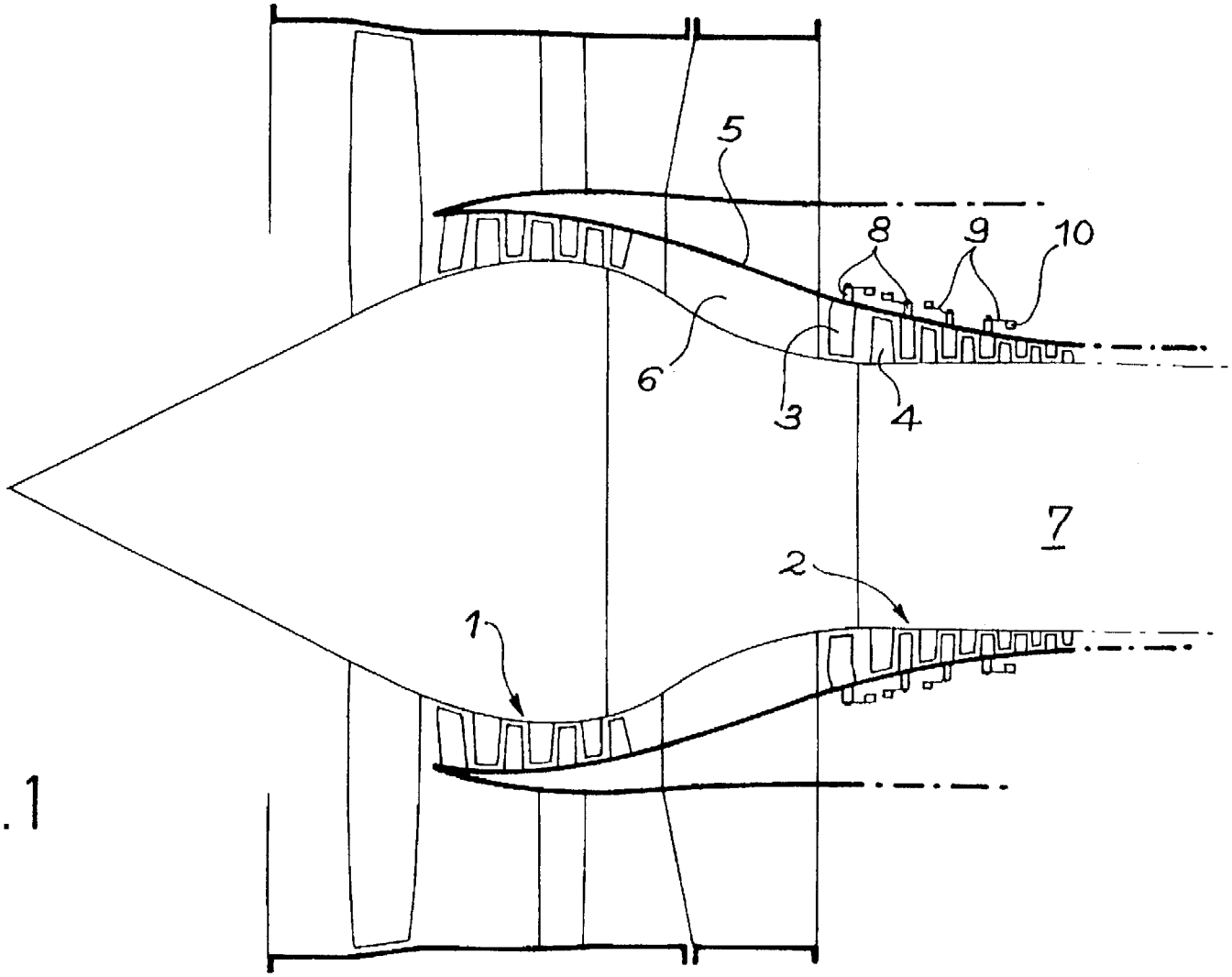
FIG. 1 represents a general view of the layout of the invention.

FIG. 1 shows the inlet of a turbomachine, particularly including a section of a low pressure compressor 1 and a section of a high pressure compressor 2. The invention is applied to the high pressure compressor section. Each compressor consists mainly of alternating stages of fixed blades 3 and stages of mobile blades 4, one set being attached to a stator 5 which surrounds the annular gas circulation stream 6 and the other set being fixed to a rotor 7 delimiting the stream 6, and rotating with it.

The fixed blades 3 may actually rotate about a pivot 8 passing through the stator 5. The pivot 8 for each blade 3 is terminated by a lever 9. The levers 9 of each stage of blades are connected to a common control ring 10.

Figure 2:
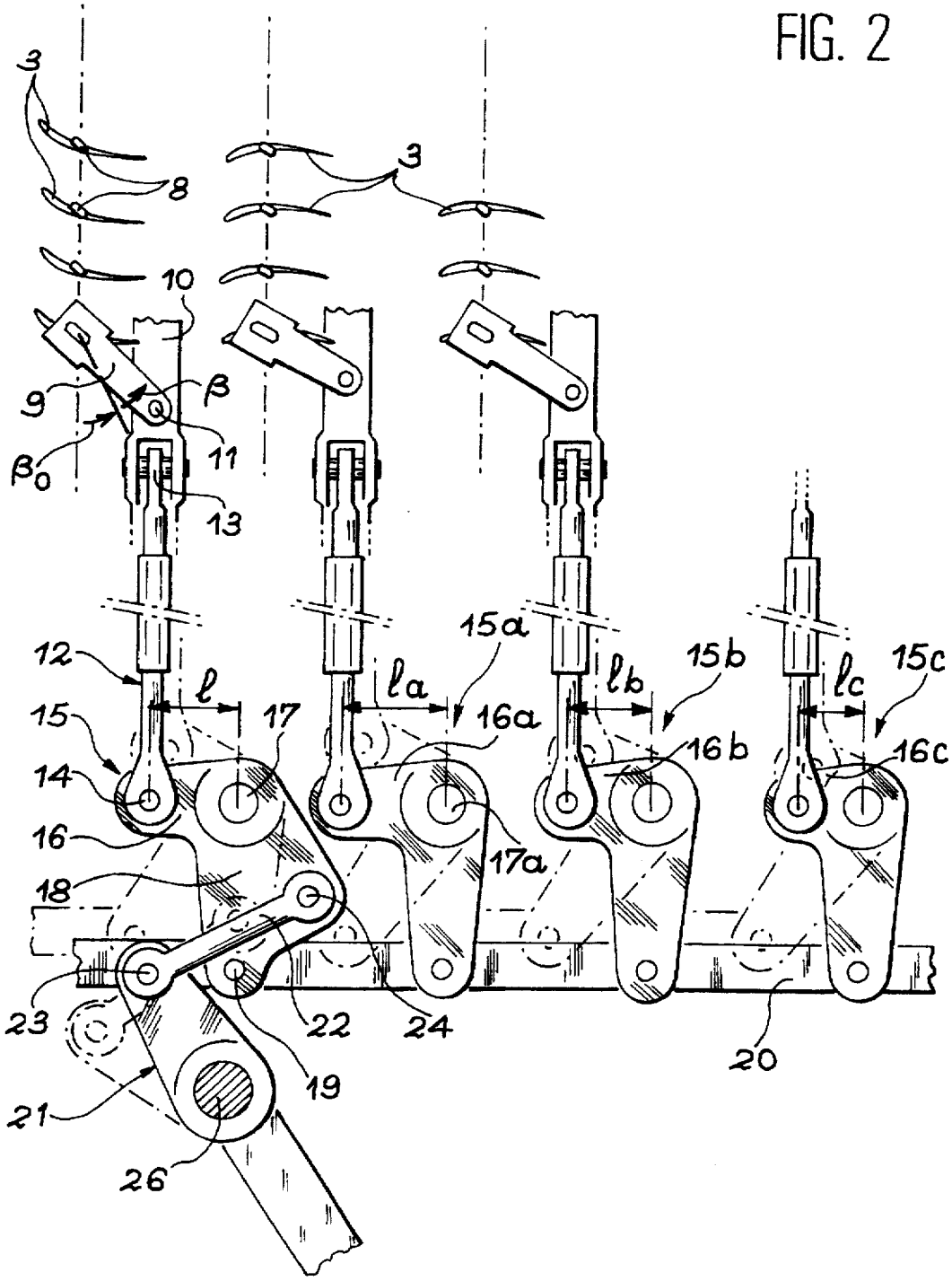
FIGS. 2 and 3 represent a first embodiment of the invention.
Figure 3:
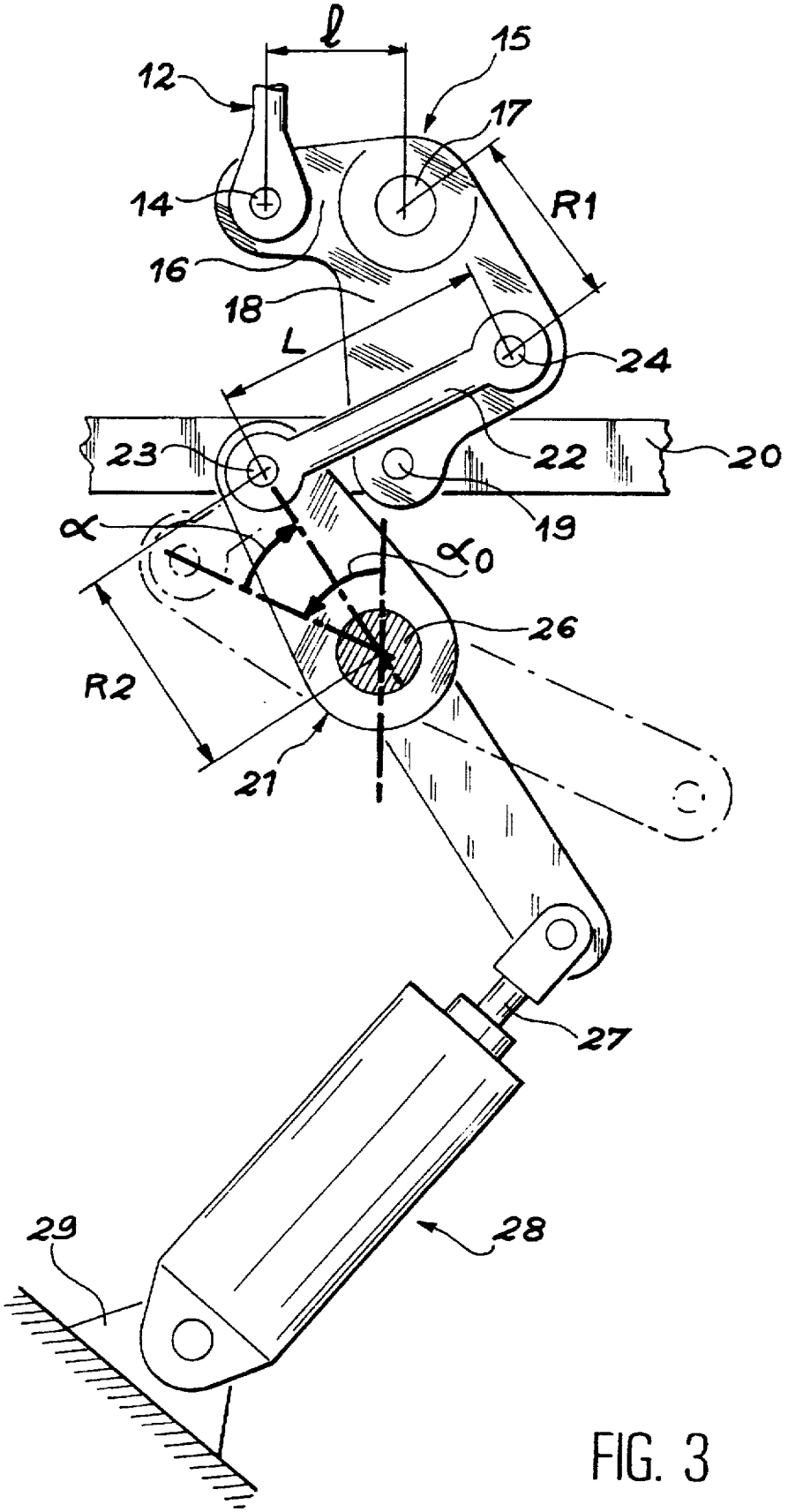

FIGS. 2 and 3 show that the levers 9 for a stage with the associated control ring 10 are attached at hinges 11 which hold the control ring 10 in position, while allowing it to rotate about itself. This can be done by providing the control ring with a transmission rod 12, one end 13 of which is hinged thereto in order to allow angular displacements of the transmission rod 12, and the other end of which 14 is hinged to a cam 15 in the form of an angled lever and more precisely to the end of one of the arms 16 of this angled lever.

A fixed axis 17 on the stator is placed at the bend in cam 15 so that it can rotate and its other arm 18 extends to the other end of transmission rod 12, and at its end there is another hinge 19 which supports a synchronization bar 20 perpendicular to the control ring 10, i.e. lying along the axial direction of the machine. The synchronization bar 20 is hinged in the same way to other cams 15 installed to control other fixed blade stages 3 through transmissions similar to that we have just described and which in particular include a control ring 10 for each stage. The only difference is that the other cams denoted 15*a*, 15*b*, 15*c*, etc. have arms 16*a*, 16*b*, or 16*c*, etc. hinged to transmission rods 12 with different lengths l, la, lb, lc, etc. As we will see shortly, this makes it possible to control the stages of fixed blades 3 differently, i.e. to impose different rotations on them. But the second arms 18 are all of the same length and are parallel, so that the synchronization bar 20 is hinged to cams 15, 15*a*, 15*b*, 15*c*, etc., at exactly the same position as fixed axes 17, 17*a*, 17*b*, 17*c*, etc.

Unlike a solution previously used by the applicant, the control mechanism does not consist of a lever fixed to the fixed axis 17 of cam 15 considered first, and the purpose of which is to make cam 15 rotate to pull or push on control rods 12 through all cams 15 and the synchronization bar 20. Instead of this, there is a crank 21 that rotates about a second fixed axis 26 parallel to the first fixed axes 17, 17*a*, 17*b*, 17*c*, etc., and a connecting rod 22 with hinged ends, the first end 23 being hinged to the end of crank 21, and the second end 24 being hinged to a portion of second arm 18 away from the fixed axis 17.

The control equations for the blade 3 rotation angle $\beta$ as a function of the crank 21 rotation angle $\alpha$ depend essentially on the length L of connecting rod 22 between hinges 23 and 24 and the measured radii $R_1$ and $R_2$ on cams 15 between fixed axis 17 and hinges 14 and 24. Finally, with this mechanism in which crank 21, connecting rod 22, cams 15, 15*a*, 15*b*, 15*c*, etc., the synchronization bar 20 and control rods 12 are substantially in a plane perpendicular to fixed axes 17, 17*a*, 17*b*, 17*c*, etc., and 26, we obtain the following formula starting from the initial angular positions $\alpha_0$ and $\beta_0$:

$$\frac{\beta+\beta 0}{2} = A\tan t,$$

where t is a root of the equation $$t^2(Z-K)+2tT-Z-K=0,$$

where $$T=[R_2 \sin(\alpha_o-\alpha)-x],$$

$$E=[-R_2 \cos(\alpha_0-\alpha)+y]$$

and $$K = \frac{L^2 - (T^2 + Z^2 + R_1^2)}{2R_1};$$

x and y are measurements of the distance between the fixed axis 26 and the fixed axis 17, projected onto axes parallel to the synchronization bar 20 and control rings 10 respectively, after being projected into the plane of FIGS. 2 and 3.

Therefore, the angle β is a sine function of angle α.

Crank 21 may be rotated by rod 27 of a jack 28 hinged at a fixed point 29, in a typical design.

The rotation angles β applied to levers 9 and blades 3 are different for the various stages, and more precisely they are proportional to lengths l, la, lb, lc, etc., of arms 16 between the fixed axis 17 and the hinge 14 in transmission rod 12, in other words all rotation curves are sinusoidal.

Figure 4:
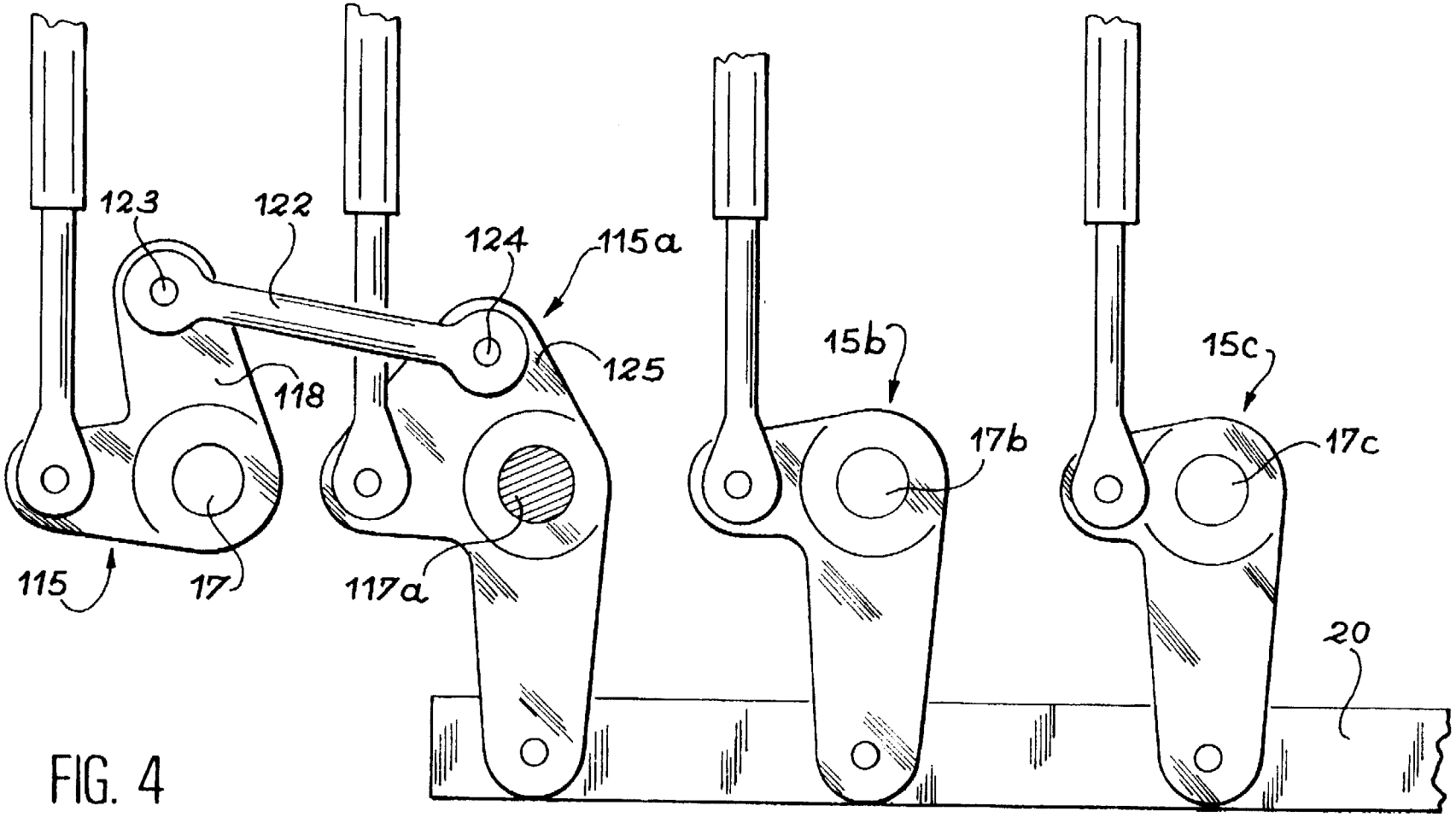
FIG. 4 represents another embodiment of the invention.

In the design shown in FIG. 4, one of the fixed blade stages 3, at the left of the figure, is itself moved according to a non-linear function, but the other are displaced proportionally to the displacement of the actuator. Using the notations on FIGS. 2 and 3, there is the same synchronization bar 20 to which cams 15*b*, 15*c*, etc., are hinged. The modifications relate to cams 15 and 15*a*; cam 15, now denoted 115, is no longer connected to the synchronization bar 20 and its second arm 18 is replaced by a different shape arm 118 designed to house a hinge 123 connecting it to one end of a connecting rod 122 similar to connecting rod 22, and the other end of which is connected by hinge 124 to a projection 125 formed on cam 115*a* which is similar to cam 15*a* and located at the same position. Another difference is that fixed axis 117*a* about which cam 115*a* rotates is not an inert axis but a control axis that depends on the actuating device. In other words, crank 21 in the previous embodiment is eliminated and cam 115*a* is a driving lever.

I claim:

1. Device for the control of a stage of blades (3) with variable pitch fitted with levers (9) connected to a control ring (10), the control ring (10) being hinged to a cam (15, 115) that pivots about a first fixed axis (17) characterized in that cam (15, 115) is connected to a control crank (21, 115*a*) rotating about a second fixed axis (26, 117*a*), parallel to the first fixed axis (17) by a connecting rod (22, 122) hinged to the cam and to the rotating crank at distinct points on the fixed axes.

2. Control device in accordance with claim 1, characterized in that it includes other cams (15*a*, 15*b*, 15*c*, etc.) that pivot about other first fixed axes (17*a*, 17*b*, 17*c*, etc.) to other control rings (10) on other stages of blades (3) with variable pitch, the cams being connected together by a synchronization bar (20) hinged to the cams at identical positions with respect to the first fixed axes.

3. Control device in accordance with claim 1, characterized in that it comprises other cams (15*b*, 15*c*, etc.) hinged so that they pivot about other fixed first axes (17*b*, 17*c*, etc.) to other control rings in other stages of blades with variable pitch, the other cams being connected together and to the rotating crank (115*a*) by a synchronization bar (20) hinged to the other cams and to the rotating crank at exactly the same positions with respect to the other fixed first axes and the second fixed axis (117*a*).

* * * * *